United States Patent [19]

Emler et al.

[11] Patent Number: 4,690,107

[45] Date of Patent: Sep. 1, 1987

[54] FLOW ENHANCER FOR REED INLET VALVES

[76] Inventors: Don R. Emler, 1430 West 259th St., Harbor City, Calif. 90710; Glenn M. Thomas, 11621 Kathy La., Garden Grove, Calif. 92643

[21] Appl. No.: 873,590

[22] Filed: Jun. 11, 1986

[51] Int. Cl.[4] ..... F02B 75/02

[52] U.S. Cl. ..... 123/65 V; 123/73 V; 138/44

[58] Field of Search ..... 123/73 V, 65 V, 73 A; 138/44

[56] References Cited

U.S. PATENT DOCUMENTS

| | | | |
|---|---|---|---|
| 1,627,161 | 5/1927 | Edwards | 138/44 |
| 3,167,333 | 1/1965 | Hall et al. | 138/44 |
| 4,474,145 | 10/1984 | Boyesen | 123/73 R |

FOREIGN PATENT DOCUMENTS

| | | | |
|---|---|---|---|
| 811499 | 4/1937 | France | 138/44 |

*Primary Examiner*—Craig R. Feinberg

*Assistant Examiner*—David A. Okonsky

*Attorney, Agent, or Firm*—Irving B. Osofsky

[57] ABSTRACT

A substantially annular flow enhancing insert is positioned in the carburetor side of the roof prism shaped reed valve inlet frame of a two-cycle internal combustion engine. The insert's flow passage is shaped so as to prevent flow separation due to large angular changes in the flow passage. The insert has two extended tapering wedges, each wedge positioned flush against the inner surface of the two opposite parallel triangular walls of the inlet frame. Each wedge directs the inlet flow smoothly to the reed valve openings and eliminates flow passage discontinuities that are normally present within the inlet frame. The remainder of the insert is closely matched to the carburetor duct and reed valve inlet frame contours so as to eliminate surface discontinuities and thereby enhance the flow into the engine. A second substantially annular insert is placed in the carburetor duct and is used to closely match the contour of the carburetor duct to the contour of the above described substantially annular insert in the carburetor side of the roof prism shaped reed valve inlet frame.

8 Claims, 7 Drawing Figures

FLOW ENHANCER FOR REED INLET VALVES

BACKGROUND OF THE INVENTION

Two stroke internal combustion engines have one inlet-compression and one power-exhaust stroke with every complete revolution of the crankshaft. The inlet, compression, power and exhaust strokes are completed in just two strokes of the piston that result from a single 360 degree revolution of the crankshaft. These engines are usually high speed, low weight/power machines which are commonly used to power motorcycles, go-carts, snowmobiles, jet-skis, small aircraft, etc. Two stroke cycle internal combustion engines as used in motorcycles and in the other devices described above normally use a reed type of inlet valve to admit the fuel-air mixture into the crankcase. The reed type inlet valve also acts as a check valve to prevent escape of the fuel-air mixture from the inlet port when the mixture is compressed in the crankcase by the downward motion of the piston until bypass ports that connect the crankcase to the cylinder are opened by the piston. The piston also uncovers exhaust ports in the cylinder wall (usually just prior to the inlet valve opening event). The expanding exhaust gases leave the cyllnder through the exhaust ports and the expansion wave created by their flow helps the compressed inlet gas charge to enter and fill the cylinder before the piston covers and seals the exhaust and inlet ports on its upward stroke in the cylinder where it compresses the fresh charge. A spark or glow plug fires the charge near the top of the stroke and combustion increases the internal gas pressure to the point where it performs useful work as it expands when the piston descends in the cylinder to repeat its two stroke cycle. The upward stroke of the piston increases the internal volume of the crankcase, thereby lowering the internal pressure in the crankcase. The pressure differential between the ambient atmosphere at the carburetor inlet and the crankcase interior causes air to flow through the carburetor venturi, through the carburetor to the crankcase induction pipe and through the reed valves into the crankcase. Because the power output of these engines is dependent on the weight of the air-fuel charge that is induced to flow into the engine cylinder via the crankcase during each stroke, it is imperative to minimize the flow discontinuities in the inlet system that cause pressure drops and accompanying reduction of air-fuel mixture flow into the engine.

Because the only energy that causes air to flow into the engine is the pressure differential between the crankcase and atmosphere acting on the area of flow, any obstruction or turbulence created pressure drop in the induction system will reduce the flow into the engine, hence reducing the available power from a given engine configuration. Manufacturers and motorcycle enthusiasts, especially those engaged in motorcycle racing, hill climbing and other contests, as well as racers operating go-carts, snowmobiles, jet-skis, small aircraft, etc. go to great lengths to maximize the airflow into the engines that power these machines. There are many devices on the market that claim to improve power available from factory standard motorcycle engines. Many of these claim to improve flow into the engine by reducing pressure drop in the induction system, by tuning the reed valves etc.

The inventors have found that the power enhancing attachments that were available did not attack the fundamental problem of smoothing and guiding the air-fuel flow into the immediate vicinity of the reed valves. The inventors have also researched the literature and discuss the following patents which may be construed as having similar function:

U.S. Pat. No. 4,228,770 by Boyesen describes an inlet flow smoothing device which comprises an airfoil shaped obstruction that is used to reduce the inlet flow cross sectional area upstream of the reed valve inlet frame. This obstruction will increase the flow velocity as claimed, because neglecting losses, in incompressible subsonic flow, for a given total pressure, the flow in a duct system can be defined by the following relationships given in equation form:

$$(\rho)(A)(V)=Q\ (\text{constant})=\text{mass flow rate, lbs(mass)/sec}$$

where:

$\rho$=density, mass/unit volume

A=cross sectional area, $ft^2$

V=flow velocity, ft/sec.

Hence, any restriction in cross sectional area, A, that is caused by an obstruction submerged in the flow, for a constant flow rate, Q, results in increased local velocity at the obstruction.

The point of this discussion is that any object, streamlined or not, which is submerged in a flowing gas stream experiences an aerodynamic drag which is comprised of three components: (1) wave or form drag, which is the resistance of the object to airflow caused by its shape, (2) skin friction drag caused by the shearing action of the gas flowing over the surface and (3) base drag caused by the low pressure separated region behind the immersed body. The forces that are aerodynamically generated on the body take energy from the flowing air and result in a reduced available pressure flowing into the engine. The drag of many types of airfoils have been calculated and experimentally determined. Many tables are available from textbooks and from NACA reports.

The equation for aerodynamic drag of a body submerged in a flowing airstream is given below:

$$D=C_d\rho V^2S/2$$

where:

D=drag force, lbs.

$C_d$=drag coefficient=$C_{dw}+C_{df}+C_{db}$ where:

$C_{dw}$=wave or form drag coefficient $C_{df}$=skin friction drag coefficient $C_{db}$=base drag coefficient V=flow velocity, ft/sec S=reference area, $ft^2$.

Hoerner, "Fluid Dynamic Drag" 1965 Edition, page 6-1, shows that for streamline two dimensional shapes, the value of $C_{dw}$ is in the order of 0.1, friction drag, $C_{df}$ is approximately 0.05 (page 6-9), and base drag=$C_{db}$. $C_{db}=(0.029)(d_b/d)^3/\sqrt{(C_{dw})}$, (Hoerner, pages 3-20) where:

$d_b$=diameter of the base d=diameter of the body.

If one calculates or measures the drag caused by air flowing past a submerged body, it is apparent that a considerable portion of the dynamic pressure available to pump air into the engine is lost by flow resistance around the submerged body. Although it is likely that such an inserted vane device (described by Boyesen) will actually boost available power in an engine whose induction system is designed with induction passages that have unnecessary area increases in the vicinity of the reed valve inlet, it became apparent to the inventors that a better method of improving flow to the inlet valves would not place an obstruction in the flow with its inevitable losses. The inventors made an "annular" nozzle that changes the shape of the inlet passage to smooth the flow into a duct. It has a gradual taper on the exit and acts like a venturi. The only flow losses caused by the insertion of the present invention into an engine inlet are increased skin friction losses caused only if the air has to flow over increased surface area and separation or wake losses only if the invention causes separation. These losses are negligible for the invention which is a special form of a venturi. It is well known to engineers with ordinary knowledge in fluid flow that the velocity drop of fluid flowing through a venturi is of the order of one percent (Mechanical Engineers' Handbook, Fourth Edition, Lionel S. Marks, page 253). No device which is submerged in the flow, such as an airfoil or streamlined shape has such a minor flow loss. In Engineering Aerodynamics, revised edition, sixth printing, April 1943, Diehl states on page 192 that "In addition to the general downwash field behind a lifting wing, there is a narrow wake of highly turbulent flow and fairly low resultant velocity that persists many chord lengths down-stream. The effective velocity is reduced more than 10% for a thickness about equal to the wing depth . . ." This results in a 19% loss in dynamic pressure behind the wing.

Boyesen, in his later invention, U.S. Pat. No. 4,474,145, describes a three dimensional insert that protrudes into the reed valve cage to accelerate the flow and in some cases to cause a vortex to form in the airstream. Unlike the invention described herein by these inventors, Boyesen's device protrudes three dimensionally into the airstream and reduces the total pressure of the air flowing into the engine because it takes energy from the airstream in the form of drag and separated wake turbulence. Although Boyesen's inventions could benefit specific engine designs by helping air to flow through the valves, the invention that is the subject of this application performs the same function without the inherent losses caused by a plug or vane that is submerged in the flowing airstream.

Because no satisfactory substantially loss free means of smoothing airflow into the inlet valves of reed valve equipped two-cycle engines were available on the market for use with conventional factory standard motorcycle engines, the inventors herein have built and tested annular flow smoothers for insertion into the inlet ducts of factory standard motorcycle engines. The invention comprises an annular substantially rectangular hollow insert that replaces the factory standard inlet duct insert. In some cases, there is no factory standard insert and the invention sizes his insert to fit into the opening of the roof prism shaped reed valve inlet cage. The insert fits into a recess in the roof prism shaped reed valve inlet cage and has extending from the insert (in the direction of flow) tapered contoured extensions that extend along opposite parallel triangular interior walls of the inlet cage to smooth the flow and cause it to expand outward slowly as does the exit section of a venturi. The action of the tapered extensions in causing the air to expand smoothly outward towards the two parallel sides of the reed valve cage without boundary layer separation, increases air flow through the engine inlet valves and increases the power output of the engine which depends directly on the weight of the inlet air that enters the engine during each revolution of the crankshaft.

SUMMARY OF THE PRESENT INVENTION

The present invention is an air flow directing device that is inserted into the inlet air duct of a two-cycle internal combustion engine that is fitted with reed inlet valves and a reed valve cage. It comprises a substantially annular frame that is contoured to match the inlet air duct surface with said frame having two opposing extensions that direct the air flow gradually outward to the apex of the reed valve cage thereby allowing the inlet air stream to follow the contours of the flow path without boundary layer separation and attendant pressure losses.

DETAILED DESCRIPTION OF THE INVENTION

Figure 1:
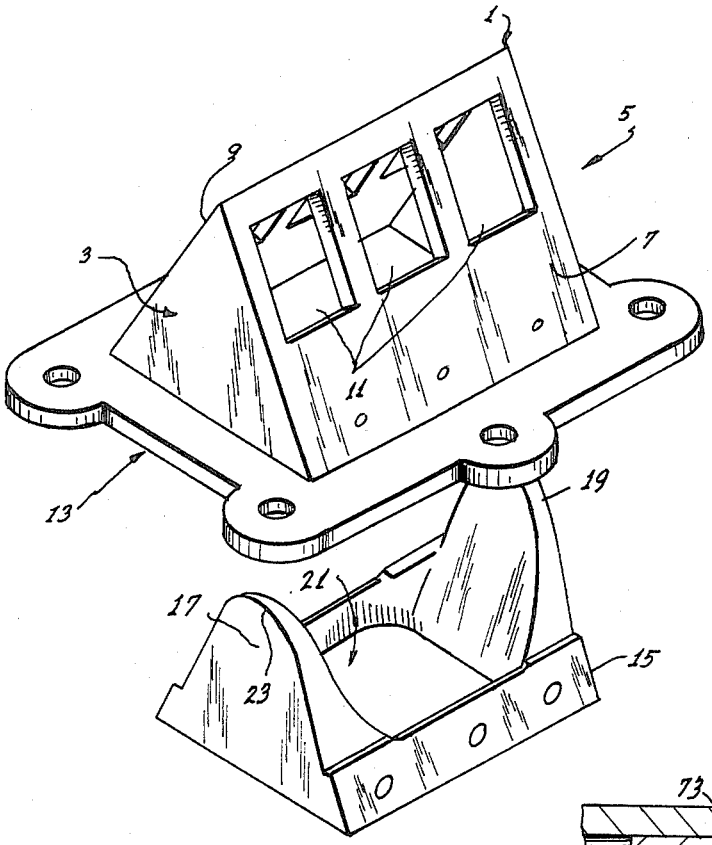
FIG. 1 is an "exploded" perspective view of the invention facing the inlet portion of a roof prism shaped inlet reed valve cage into which it, the invention, would be installed.

Referring now in detail to FIG. 1, there is illustrated a conventional roof prism shaped inlet reed valve frame 1. The frame which is usually a die cast aluminum part, has two parallel triangular faces 3 and 5. Joining these two parallel faces are the two slanted "roof" surfaces 7 and 9. Surfaces 5 and 9, are not visible in this view. Surfaces 7 and 9, have a number of rectangular ports 11, cut into their surfaces to allow the inlet air and fuel mixture to flow into the internal combustion two-cycle engine from the carburetor or fuel injector which is upstream of the reed valve inlet port. Reed valves, not illustrated in this view, cover and seal the rectangular ports 11, until differential pressure in the inlet system periodically opens them. The invention 15, is a flow area transition piece which slips into the cavity in the reed valve frame which is formed in the rear of the frame by the junction of the parallel triangular faces 3 and 5, and rectangular slanted surfaces 7 and 9. It has two substantially wedge shaped extensions 17 and 19, which fit against the inner sides of the triangular faces 3 and 5. The wedge shaped extensions are substantially triangular shaped to fit in the reed valve cage against the triangular surfaces 3 and 5, but their tips may be truncated by an arc 23, or a straight line without adversely affecting performance. The invention has a substantially annular base of rectangular outline that support the extensions 17 and 19, and guides the airflow into the reed valve cage through opening 21, along the slanted faces 7 and 9, and triangular faces 3 and 5.

Figure 2:
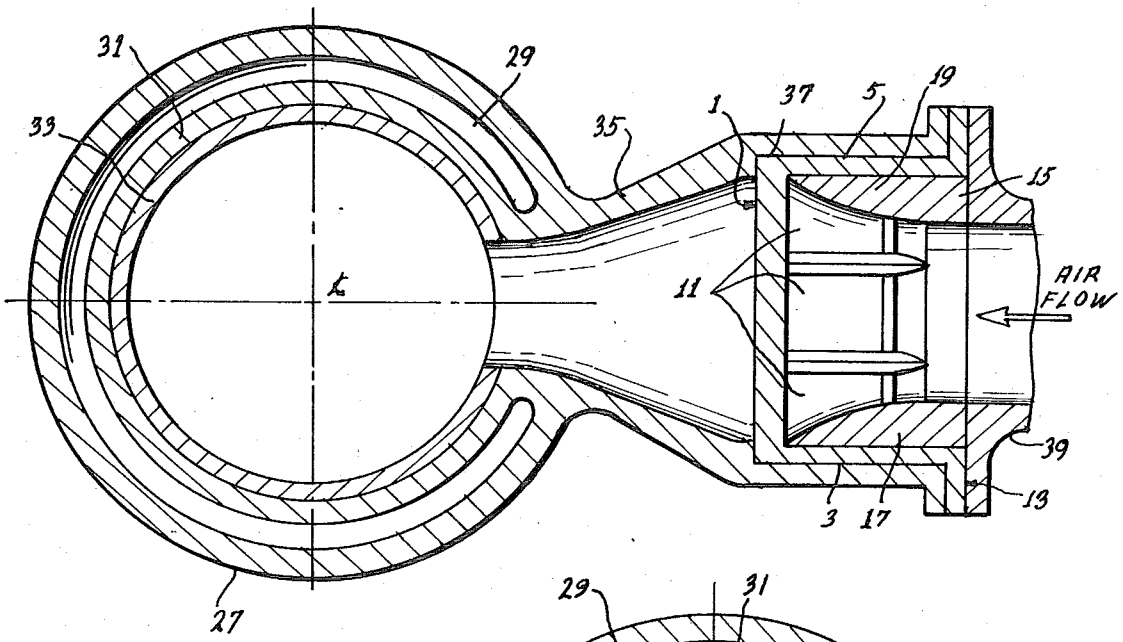
FIG. 2 is a cross section of the invention as installed in the inlet reed valve cage of a typical two-cycle internal combustion engine cylinder.

FIG. 2 is a cross sectional view of the invention as it is installed in the air inlet system of a conventional two-cycle internal combustion engine that is equipped with a roof prism shaped reed valve assembly. An aluminum alloy water cooled cylinder assembly 27, is shown for illustration purposes but any type of cylinder could be used with this invention. The cooling water passage 29, surrounds the aluminum cylinder 31, which has an iron sleeve 33, attached to it (usually a shrink or press fit). In this example, the inlet air duct 35, is an integral part of the cylinder casting. The inlet air duct has a close fitting opening 37, which accepts a reed valve inlet assembly comprising a frame 1, reed valves (not illustrated in this drawing) and an inlet flow adapter 15, (the present invention is illustrated here). A duct 39, leading to the carburetor is illustrated. Inlet air flows from the carburetor through duct 39, through the adapter 15, through the ports in the reed valve frame and past the periodically open reed valves into the cylinder and engine crankcase.

Figure 3:
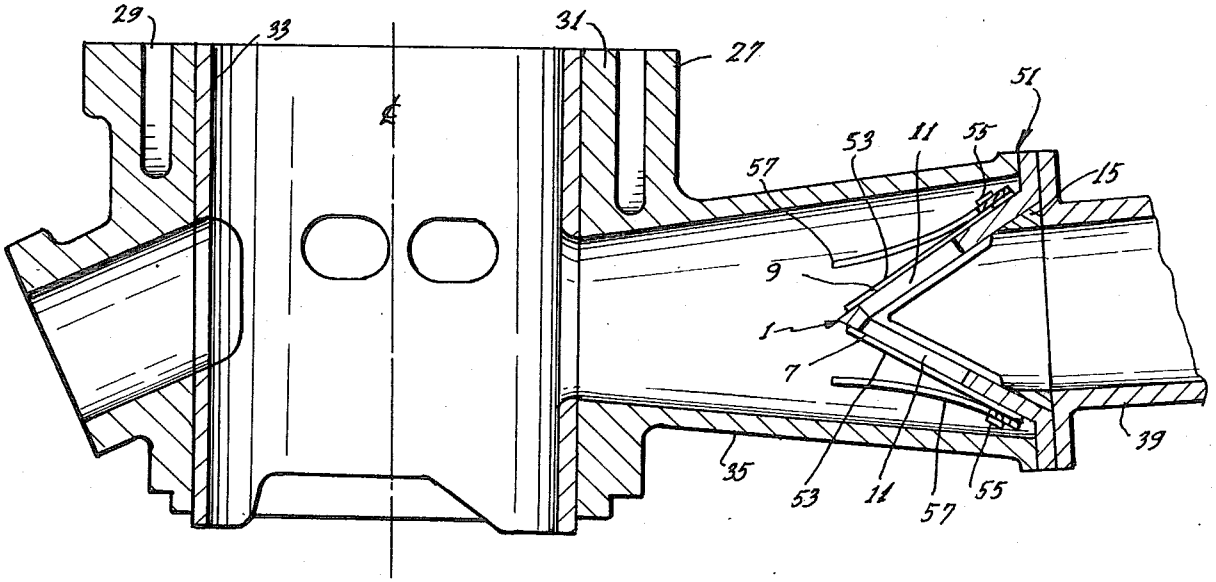
FIG. 3 is a cross section of a conventional reed valve inlet section flow transition adapter as installed to illustrate the large angular changes in the air flow path.

FIG. 3. is a cross sectional view of the invention as it is installed in the air inlet system of a conventional two-cycle internal combustion engine that is equipped with a roof prism shaped reed valve assembly. This cross sectional view is normal to the cross sectional view that is illustrated in FIG. 2. It shows the prism shaped reed type inlet valve assembly 51, with reed valve frame 1, fastened by screws 55, to the reed valves 53 and the reed valve motion limiting restraints 57. The invention 15, is shown in position between the inlet air duct 35, and the carburetor duct 39. Note that in the plane of this view the invention cross section is substantially the same as the factory supplied adapters because there is no great angular flow expansion required. In this plane, the flow is flowing into contracting surfaces and no expansion takes place (in this plane).

Figure 4:
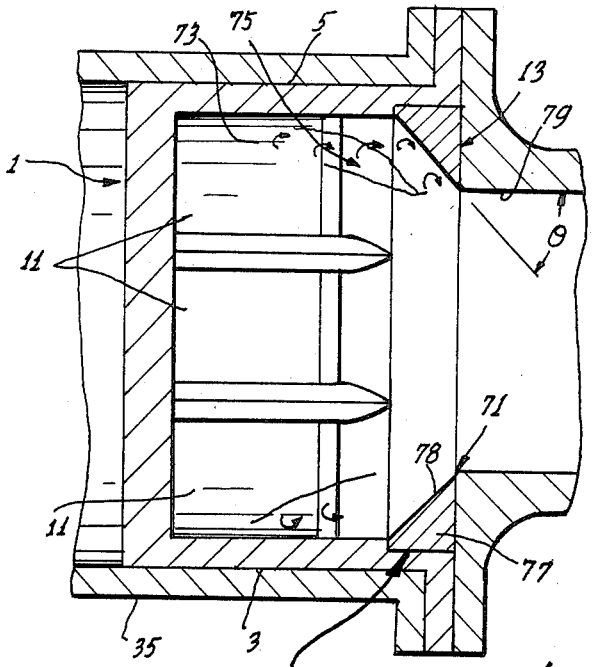
Prior Art Fig. 4
FIG. 4 is a cross section of the invention as installed in an inlet reed valve cage which illustrates the air flow patterns and compares the shape of this invention to that of conventional flow transition adapters.

FIG. 4 is a cross sectional view of the conventional factory supplied flow adapter 77, taken perpendicular to the base 13, and parallel to the intersection of slanting faces 7 and 9. It is identical to the section illustrated in FIG. 2 but enlarged and simplified to show the air flow. Angle $\theta$ is the angle between the upstream wall surface 79, of the carburetor duct and the downstream surface 78, of the adapter 77. Angle $\theta$ of the conventional factory supplied flow adapter is usually of the order of 30 degrees and therefore, separation of the flow can be expected at or near the start 71, of the divergent slope of the downstream surface 78. In the design of expansion sections for subsonic flow, it is well known to engineers that expansion angles should never exceed 7 degrees to prevent separation. Arrows 73, illustrate the probable flow path with recirculating vortices in a low pressure separated region 75. This adapter causes flow separation due to the local overexpansion and resultant internal turbulence, low pressure and flow oscillations cause a reduction in inlet air flow and dynamic pressure.

Figure 5:
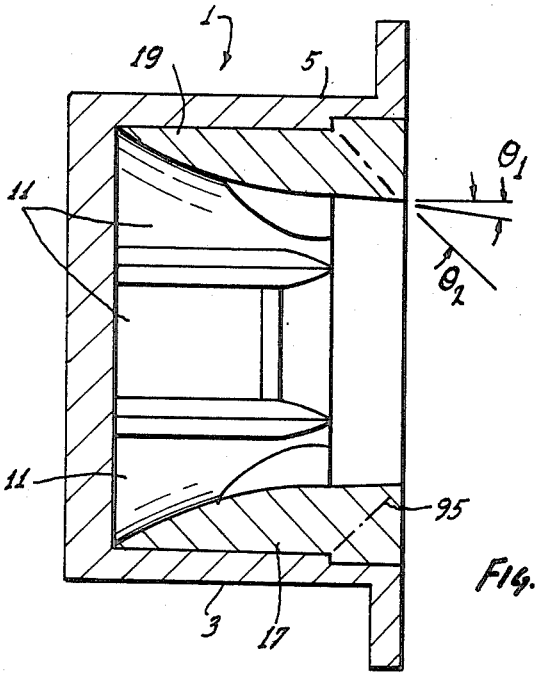
FIG. 5 is a cross section of the invention as installed in the inlet reed valve cage of a typical two-cycle internal combustion engine cylinder with an offset carburetor duct.

FIG. 5 is an enlarged view of the invention installation as previously illustrated in FIG. 2. It shows the gradual slope of the invention's guiding wedges 17 and 19. The invention is shown in heavy solid lines while the outline of the conventional flow adapter is shown by the phantom lines 95. The inlet air expansion angle is shown as $\theta_1$ for the invention and is shown as angle $\theta_2$ for the conventional flow adapter. $\theta_1$ for the invention is less than 7 degrees whereas $\theta_2$ for the conventional adapter is in the order of 30 degrees. There will be no zone of turbulence or separated flow with the invention installed because the expansion is gradual and guidance is supplied to the boundary layer all of the way to the apex of the reed valve frame.

Figure 6:
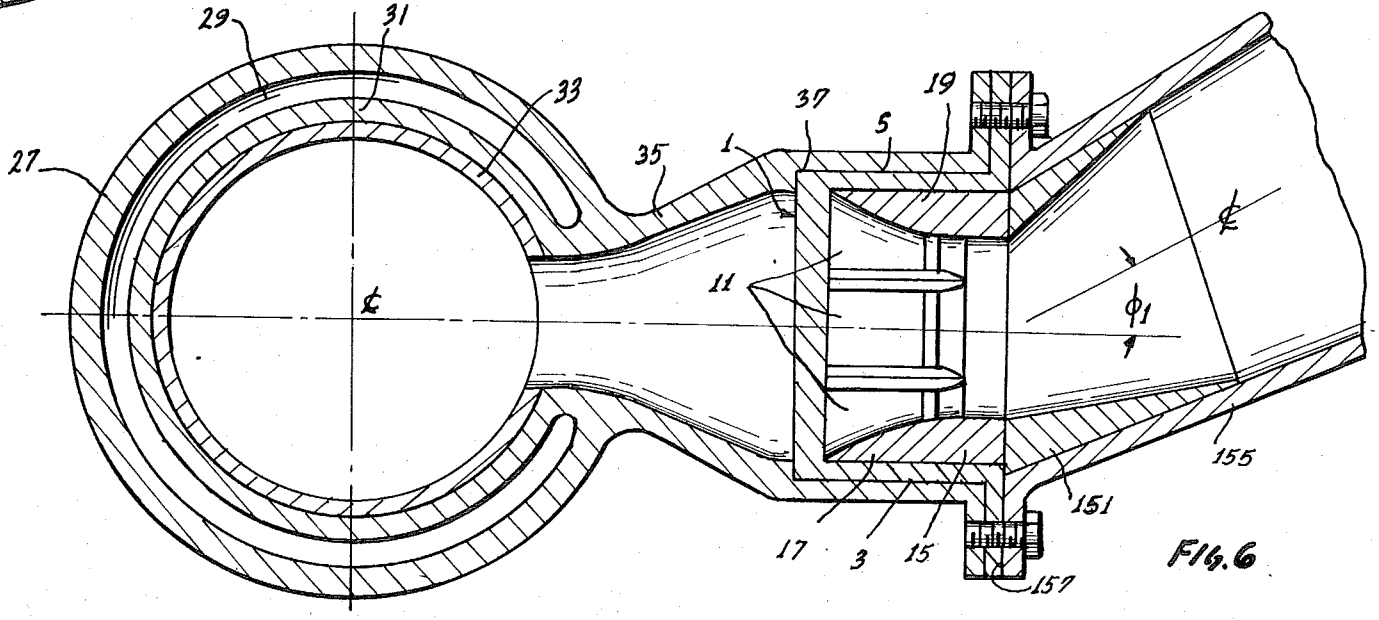
FIG. 6 is a cross section of the shape adapter invention that is taken normal to the view shown in FIG. 5.

FIG. 6 is substantially identical to FIG. 2 except that the carburetor duct 155, is offset from the centerline of the inlet air duct 35, by an angle $\phi_1$. Also, the opening of carburetor duct 155, at the adjoining surface 157, does not match the opening of the inlet reed valve frame 1. In many cases, it is substantially larger and mismatched as shown. A second feature of the invention is a substantially annular shape adapter 151, molded to closely fit the inner surface of the carburetor duct that blends the contour of the inner surface of the carburetor duct to the inner contour of the inlet flow adapter 15. The flowing air sees no substantial discontinuities in the surfaces and tends to flow from the carburetor duct into the inlet flow adapter without separation and losses. This shape adapter can also be used to reduce flow losses due to duct cross section incompatibility with the conventional factory supplied adapter 77, or the reed valve inlet frame without an adapter. The length of the shape adapter 151, is approximately equal to the minimum diameter of its opening. The inventors have found that this length is not critical to its operation. The inventors have found that the invention works best when the opening of the shape adapter at the mating surface 157, is always slightly smaller than the opening of the matching opening in the mating part. This prevents any mismatch from appearing as a step type constriction in the flow duct. The inventors fabricated this part of the invention from plastic and molds as described for the primary invention.

Figure 7:
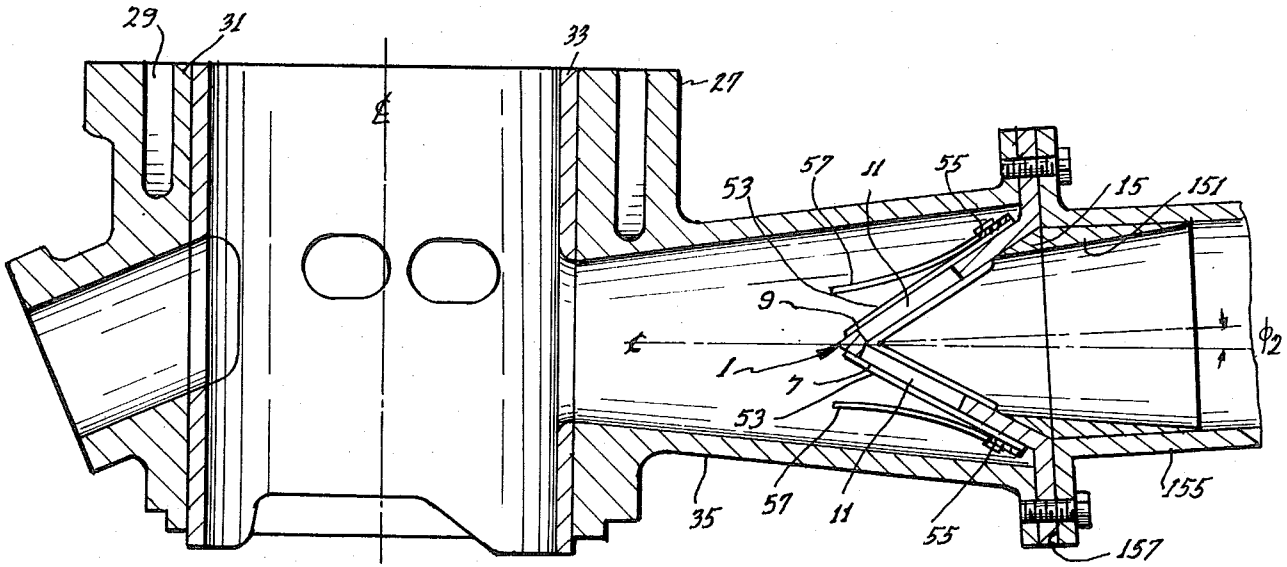
FIG. 7 is a cross section of the shape adapter invention that illustrates how it matches the non-conforming cross section of a carburetor duct to the cross section of the insert in an inlet reed valve cage.

FIG. 7 is substantially similar to FIG. 3 with a non-matching carburetor duct 155. The shape adapter 151, blends the contour of the inner surface of the carburetor duct to the inner contour of the inlet flow adapter 15. In this view, the carburetor duct centerline is illustrated as being substantially in line with the inlet duct centerline which may be inclined at angle $\phi_2$ with respect to an axis normal to the cylinder centerline.

The advantages of this construction over previous designs are as follows:

1. Cost of construction is low because the invention is of simple molded plastic construction and custom molds are inexpensively and easily constructed by adding wax to a conventional flow adapter to change its shape to the desired contours and add flow control wedges and gates to form a male pattern and then making a silicone rubber mold from the modified flow adapter. Plastic is then poured into and hardened in the mold to form the invention. The shape adapter may be modeled in wax, using the desired carburetor duct as a female mold, and the wax pattern may be used to make molds from which plastic shape adapters are cast.

2. Power and torque available from a two-cycle engine with a conventional roof prism shaped reed valve assembly can be increased by use of the invention to reduce inlet air ducting losses.

3. The invention can be inexpensively retrofitted to almost any roof prism shaped reed valve inlet surface without performing any machining operation on the engine, engine ducts or inlet valves.

4. Only ordinary skill is required to install the invention on an engine. No training, experience or judgment is required. An alternate description of the flow enhancer invention is given below:

1. The invention is an insertable flow smoothing annular insert that is designed to prevent separation of the air flow boundary layer and to reduce or eliminate turbulence in the air flowing into the inlet portion of a roof prism shaped reed inlet valve assembly that is used in two-cycle internal combustion engines.

2. A flow enhancer insert for use in the carburetor facing side of a roof prism shaped reed valve inlet frame of a two-cycle internal combustion engine comprising:

an annular ring fitting in a space within the inlet frame between the carburetor duct leading to the reed valve inlet frame and the said inlet frame, said ring being flush with the face of the inlet frame opening and matching the contour of the carburetor duct to the contour of the interior of the roof prism shaped inlet frame; and two substantially triangular planform wedges, each shaped so as to extend from opposite sides of the annular ring towards the interior apex of the inlet frame and each wedge to substantially cover the interior surface of each of the two parallel triangular surfaces of the said inlet frame with the wedge angle tapering outwards from the interior of the annular ring to cause substantially zero wedge thickness at the apex of each wedge and each wedge being attached at its base to the annular ring.

3. The flow enhancer of paragraph 2 in which the wedge face that directs the air flow has a taper angle less than that which would cause flow separation in the adjacent air stream.

4. The flow enhancer of paragraph 2 in which the wedge face that directs the air flow has a taper angle less than 8 degrees.

5. The flow enhancer of paragraph 2 in which the wedge face that directs the flow is formed from a substantially plane surface.

6. The flow enhancer of paragraph 2 in which the wedge face that directs the flow is formed from a curved surface that is substantially tangent to the annular ring and gradually turns the flow outward towards the outer apex of the parallel triangular surfaces of the inlet frame.

7. A substantially annular duct shape adapter that fits within an upstream inlet air duct in a two-cycle internal combustion engine which adapter is formed to closely fit the inner surface of the upstream inlet air duct and blend the contour of the inner surface of the upstream inlet air duct to closely match the inner contour of the opening of the mating downstream air passage.

8. The shape adapter of paragraph 7 which blends the two air passage cross sections in a distance substantially equal to one upstream duct diameter.

9. The shape adapter of paragraph 7 in which the dimensions of the opening of the downstream face are slightly smaller than the dimensions of the mating downstream air passage.

10. The flow enhancer of Paragraph 1 in which the material of construction is plastic.

11. The flow enhancer of Paragraph 1 in which the material of construction is reinforced plastic.

12. The flow enhancer of Paragraph 1 in which the material of construction is metal.

13. The shape adapter of Paragraph 7 in which the material of construction is plastic.

14. The shape adapter of Paragraph 7 in which the material of construction is reinforced plastic.

15. The shape adapter of Paragraph 7 in which the material of construction is metal.

The preferred embodiment for the invention uses a gasoline resistant material which is fabricated by casting. The inventors used an aluminum filled epoxy mass casting resin. A commercially supplied "TC 1650 A/B High-temp Aluminum Filled Mass Casting Resin System" was supplied by BJB Enterprises, Inc. 6350 Industry Way, Westminster, CA. 92683. This resin is cured by heating in an oven according to a schedule supplied with the resin. A female mold was fabricated with silicone rubber mold material in which a female cavity is formed to the desired outline of the exterior of the invention. Allowance is duly made for shrinkage during the molding process. The mold cavity is treated with a release agent to allow ready removal of the invention from the mold after solidification takes place. The inventors fabricated the mold by first forming the desired shape of the invention from wax, spraying the wax pattern with release compound and then immersing the wax pattern in a container of silicone molding rubber. Suitable gates were provided with the pattern. After the rubber mold cured, it was removed from the pattern. Production parts are fabricated by pouring an epoxy plastic molding compound into the mold and allowing it to cure in a heated oven. After cure, the finished invention was removed and trimmed to remove flash and gates. The inventors have used the above described TC 1650 resin system as the molding plastic for his invention but many other compounds can be used. Metal can also be used to fabricate the invention in die casting permanent molds if desired. Of course, for high production runs, permanent molds and automatic plastic injection molding machines would probably be used. The inventors make the invention so that it is a close fit into the mating engine parts. Clearances between the invention and mating parts are in the order of thousands of an inch but the action of the invention is such that very close tolerances are not necessary except at the junction of the invention with the carburetor duct. At this junction, the invention should match the cross section of the carburetor duct closely to prevent boundary layer separation due to mismatch of the surfaces. It is the preferred mode to have the invention slightly larger than the carburetor duct cross sectional outline so that no intrusive step projects into the airstream.

While certain exemplary embodiments of this invention have been described above and are shown in the accompanying drawings, it is to be understood that such embodiments are merely illustrative of, and not restrictive on, the broad invention and that we do not desire to be limited in our invention to the specific constructions or arrangements shown and described, because various other obvious modifications may occur to persons having ordinary skill in the art.

What is claimed is:

1. A flow enhancer insert for use in a roof prism shaped reed valve inlet frame of a two cycle internal combustion engine comprising:

an annular ring secured into an upstream portion of the reed valve inlet frame adjacent to a carburetor duct leading to the reed valve inlet frame, said ring being flush with an upstream opening face of the reed valve inlet frame and matching a downstream contour of the carburetor duct to an interior contour of the reed valve inlet frame; and two substantially triangular wedges each shaped so as to extend downstream from opposite sides of the annular ring and substantially to an interior apex of the reed valve inlet frame and each wedge to substantially cover an entire interior surface of each of two parallel triangular surfaces of the reed valve inlet frame with each wedge tapering outwards from the interior of the annular ring to cause substantially zero wedge thickness at an apex of each wedge and each wedge being attached at its base to the annular ring.

2. The flow enhancer of claim 1 in which a wedge face that directs air flow has a taper angle less than that which would cause flow separation along the air flow path.

3. The flow enhancer of claim 1 in which a wedge face that directs air flow has a taper angle less than 8 degrees.

4. The flow enhancer of claim 1 in which a wedge face that directs air flow is formed from a substantially plane surface.

5. The flow enhancer of claim 1 in which a wedge face that directs air flow is formed from a curved surface that is substantially tangent to the annular ring and gradually turns air flow outward towards the apex of the parallel triangular surfaces of the reed valve inlet frame.

6. A substantially annular duct shaped adapter secured into an upstream portion of the carburetor duct adjacent to and in combination with the flow enhancer of claim 1, said duct shaped adapter's upstream inner surface closely fitting an inner surface of said upstream portion of the carburetor duct and said duct shaped adapter shaped on its inner surface to blend a contour of the inner surface of said upstream portion of the carburetor duct to closely match an inner contour of an upstream edge of the flow enhancer insert.

7. The duct shaped adapter of claim 6 which blends the upstream portion of the carburetor duct cross section with the upstream edge of the insert flow enhancer insert in a distance substantially equal to a diameter of the carburetor duct.

8. The duct shaped adapter of claim 6 in which the cross sectional area at the upstream edge of the flow enhancer insert is substantially equal to the cross sectional area at a downstream edge of the duct shaped adaptor so as to prevent a step type reduction of cross sectional charge flow area at the junction of the duct shaped adapter and said flow enhancer insert.

* * * * *